US006647685B2

(12) United States Patent
Annarella et al.

(10) Patent No.: US 6,647,685 B2
(45) Date of Patent: Nov. 18, 2003

(54) SPACING DEVICE FOR PLACEMENT OF TILE

(75) Inventors: Joseph L. Annarella, Schaumburg, IL (US); Robert Grzybowski, Arlington Heights, IL (US); John F. Dumelle, Beverly Shores, IN (US)

(73) Assignee: Space-It-Rite, Beverly Shores, IN (US)

( * ) Notice: Subject to any disclaimer, the term of this patent is extended or adjusted under 35 U.S.C. 154(b) by 0 days.

(21) Appl. No.: 10/044,152

(22) Filed: Jan. 10, 2002

(65) Prior Publication Data

US 2003/0126815 A1 Jul. 10, 2003

(51) Int. Cl.[7] ..... E04F 13/08

(52) U.S. Cl. ..... 52/392; 33/526; 33/527; 52/747.11

(58) Field of Search ..... 52/392, 389, 127.1, 52/127.2, 127.3, 127.5, 384, 747.11, 749.11; 33/526, 527

(56) References Cited

U.S. PATENT DOCUMENTS

| | | | | | |
|---|---|---|---|---|---|
| 2,031,684 | A | * | 2/1936 | Berger | 52/396.1 |
| 4,793,068 | A | * | 12/1988 | Golkar | 33/526 |
| 4,862,668 | A | * | 9/1989 | DeGooyer | 52/747.11 |
| 4,953,341 | A | * | 9/1990 | Joos | 52/747.11 |
| 5,288,534 | A | * | 2/1994 | Tavshanjian | 428/64.1 |
| 5,359,783 | A | * | 11/1994 | Smith | 33/527 |
| 5,623,799 | A | * | 4/1997 | Kowalski et al. | 52/392 |

FOREIGN PATENT DOCUMENTS

| | | | |
|---|---|---|---|
| EP | 1111157 | * | 6/2001 |
| GB | 2331322 | * | 5/1999 |
| GB | 2334731 | * | 9/1999 |

* cited by examiner

*Primary Examiner*—Anita King
*Assistant Examiner*—Tan Le
(74) *Attorney, Agent, or Firm*—Banner & Witcoff, Ltd.

(57) ABSTRACT

A tool for the spacing of tiles during installation includes a central body with radially projecting prongs that are fitted between adjacent tiles to control the spacing thereof.

8 Claims, 4 Drawing Sheets

FIG.4
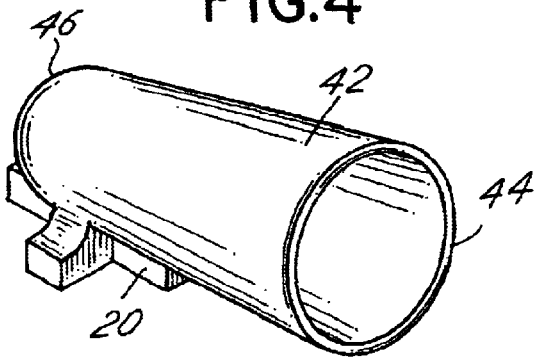
FIG.5
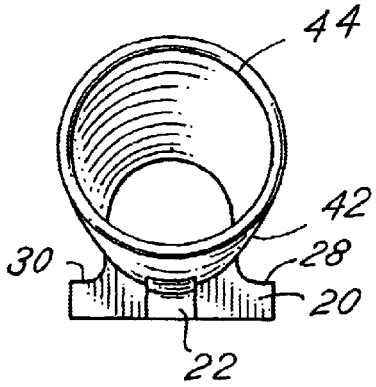
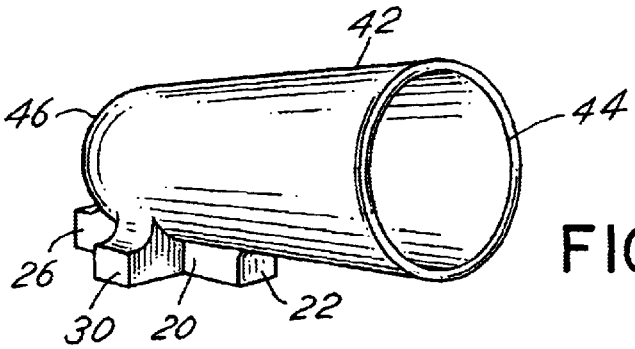
FIG.6
FIG.7
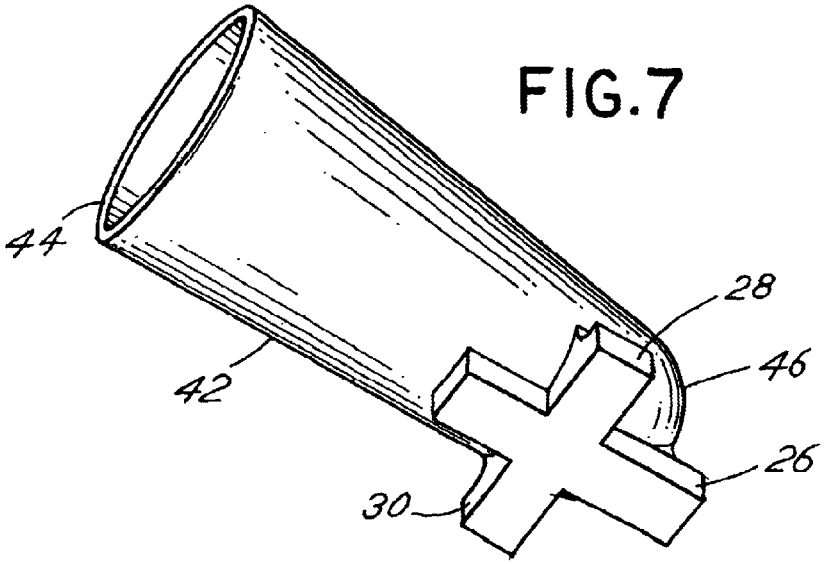

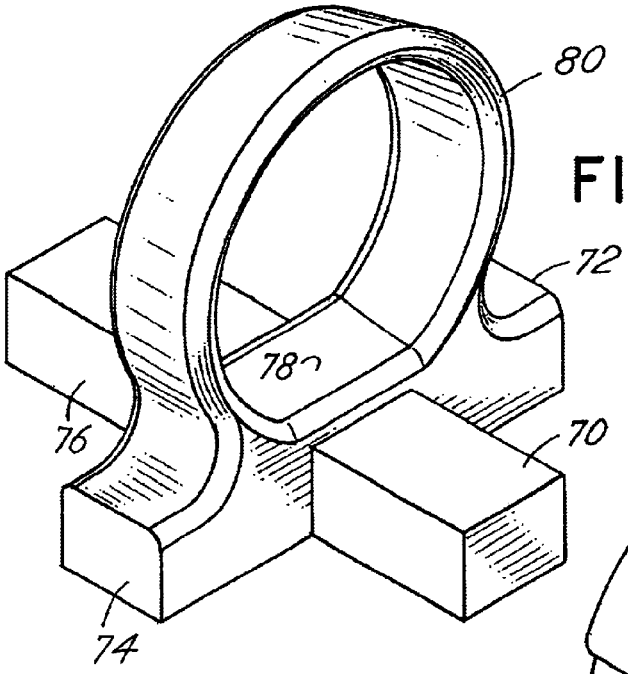
FIG.10
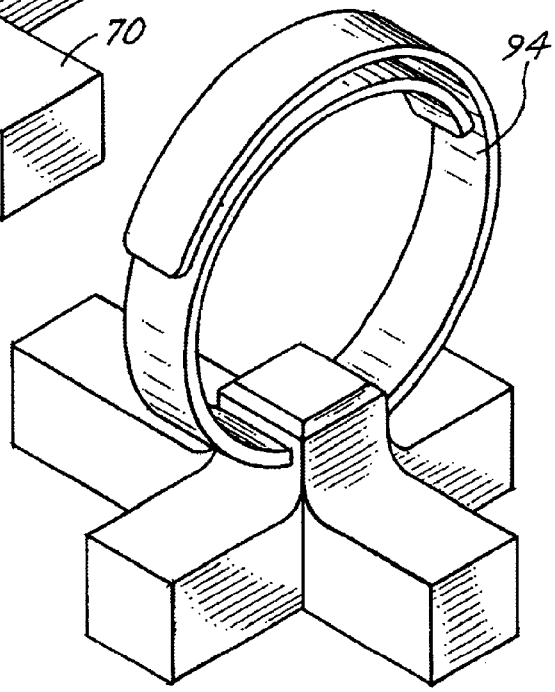
FIG.12
FIG.11
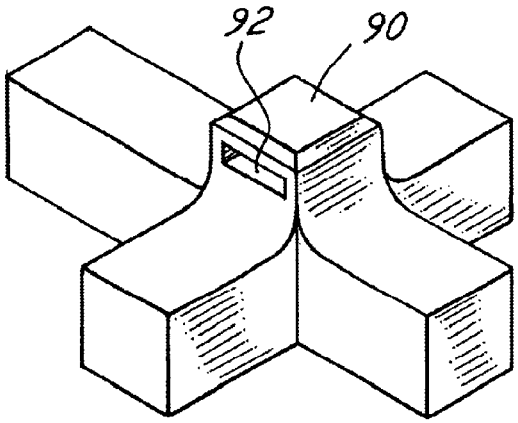

SPACING DEVICE FOR PLACEMENT OF TILE

BACKGROUND OF THE INVENTION

In a principal aspect the present invention relates to a tool that may be utilized to properly and uniformly space ceramic, floor and wall tiles during their installation as well as clean or rake the joint between adjacent tiles.

When installing tiles, such as ceramic tiles, on a floor or wall surface, it is common to provide a narrow or small seam between the separate, adjacent tiles. The tiles, thus, are typically glued or somehow adhered to the surface in an array separated by narrow seams or slots. Thereafter, grout is filled into the slots' seams between the tiles.

When setting tiles, therefore, it is desirable and necessary to provide clean and uniform spacing of adjacent tiles before inserting the grout into the area or slots between the tiles. Properly spacing the tiles is often a challenging task for tile setters. Spacing devices such as small wedges of wood or other material have been utilized to provide for desired spacing of tiles during setting. Such spacing members are inserted between the tiles as the tiles are placed on a surface and moved by sliding or other slight adjustments. The spacing of tiles utilizing this approach may or may not be uniform. Moreover, spacing of adjacent tiles, particularly at junctions associated with the corners of the tiles is not always uniform and is difficult to maintain. Thus, there has developed a need to provide an improved method as well as tool to ensure proper spacing between tiles as they are laid and set upon a surface.

SUMMARY OF THE INVENTION

Briefly, the present invention comprises a spacing tool for facilitating installation of tiles on a surface having adhesive or other similar material to promote adherence of the tiles to the surface. The spacing tool includes a central body with projecting spokes from the body. The body and the spokes are typically coplanar. The spokes are arranged in a manner which is congruent or coincident with the spacing or slot size between adjacent tiles and the junction of three or more tiles. Thus, the prongs projecting from the central body will typically have, by way of example, a cruciform shape. A thimble section or other holding mechanism is mounted on the top of the central body to facilitate gripping, movement and placement of the tool between tiles. Thus, the tool is utilized by positioning tiles upon a surface and adjusting their spacing to abut against the sides or edges of the prongs of the spacing tool. The thimble or holding section, which is positioned on the top of the body section of the tool, facilitates manual manipulation and positioning of the tool when adjusting the spacing between the tiles. The tiles may thus be set on adhesive or similar material with the tool having one or more of the prongs positioned between adjacent tiles thereby providing a means for adjusting or limiting the movement and motion of the tiles so that they will be uniformly spaced by virtue of the width of the prongs associated with the tool. The prongs may also be utilized to clean the slots by removal of excess adhesive, for example, or to rake the grout in the slots.

Thus, it is an object of the invention to provide an improved tool for spacing of tiles during their installation.

It is a further object of the invention to provide a tool for the spacing of tiles which has a simple yet highly efficient construction, is inexpensive, rugged and durable.

Another object of the invention is to provide a method for the setting of tiles in a uniformly spaced manner.

A further object of the invention is to provide various alternative embodiments of a tile spacing tool wherein distinct embodiments can be used in combination with distinct tile shapes.

These and other objects, advantages and features of the invention will be set forth in the detailed description which follows.

BRIEF DESCRIPTION OF THE DRAWING

In the detailed description which follows, reference will be made to the drawing comprised of the following figures;

FIG. 4 is an isometric view of the embodiment of FIG. 1;

FIG. 5 is an end view of the tool of FIG. 1;

FIG. 6 is an isometric view of the embodiment of FIG. 1;

FIG. 7 is an isometric view of the bottom of the tool of FIG. 1;

FIG. 10 is a second embodiment of a tool for spacing tiles;

FIG. 11 is an isometric view of a portion of a third embodiment of the tool; and FIG. 12 is an isometric view of the embodiment of FIG. 11 further including and incorporating a thimble section for the tool.

DESCRIPTION OF THE PREFERRED EMBODIMENT

Figure 2:
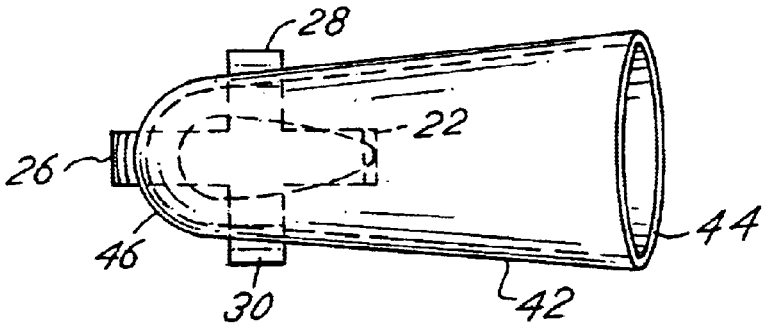
FIG. 2 is a top plan view of the embodiment of FIG. 1.

The embodiment of FIGS. 1–9 is exemplary and is not to be considered as limiting the invention. The tool of the invention includes a central or body section 20 having a first projecting prong 22 extending in a first axial direction along a longitudinal axis 24, a second axial prong 26, a third transverse prong 28 and a fourth, oppositely directed transverse prong 30 aligned with the third prong 28. The central or body section 20, as well as the prongs 22, 26, 28 and 30 are coplanar and define a bottom coplanar surface 32. Each of the prongs 22, 26, 28 and 30 has a width such as the width 36 of prong 22. The width of each prong in the preferred embodiment is equal. However, the width of the prongs may be varied to thereby vary the spacing of tiles by use of the tool as will be appreciated from the description hereinafter.

Figure 1:
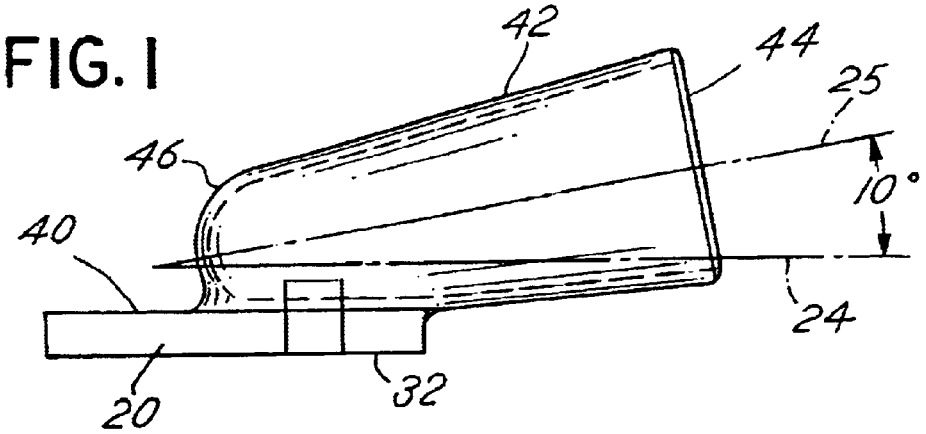
FIG. 1 is a side elevation of a first embodiment of the tool.
Figure 3:
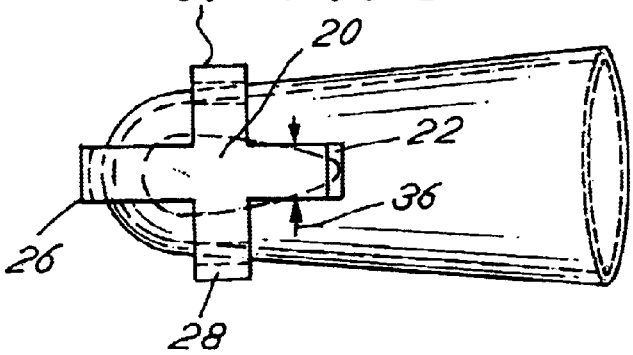
FIG. 3 is a bottom plan view of the tool of FIG. 1.

The body section 20 further includes a top face or surface 40 having a thimble section 42 thereon. The thimble section 42 in the embodiment depicted comprises an integral molded plastic frustoconical tube having a wide or open mouth end 44 and a narrow, closed arcuate end 46. An axis 25 of the thimble section 42 is aligned with the axis 25 aligned with pring axis 24. In the preferred embodiment, the thimble section 42 is symmetrical about the axis 24 as depicted in FIG. 1. In this manner, an individual using the tool will be able to properly insert their finger into the thimble section 42 in a proper orientation which enables ease of use and utility of the tool. Axis 25 is canted at an angle in the range of 0° to 45° relative to axis 24 with a preferred angle of about 10°.

Each of the prongs 22, 26, 28 and 30 have a general uniform thickness between the bottom side 32 and the top side 40. In the preferred embodiment, the prongs are arranged in a symmetrical pattern, the pattern being in the form of a cruciform. The prongs 22, 26, 28 and 30 thus extend radially outward from the center or body section 20. The prongs may all have the same radial extension or length or they may be variable in length. Typically the prongs are ⅛" to ¾" in length. If the prongs are variable in length, typically the forward prong 26 will have a greater length or radial extent from the center section 20 relative to the other prongs.

Figure 8:
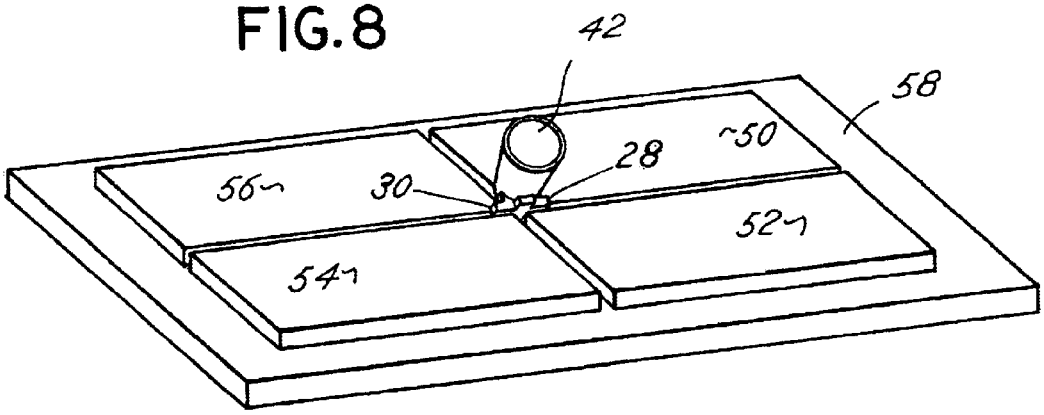
FIG. 8 is an isometric view depicting the manner and method of use of the tool of FIG. 1.
Figure 9:
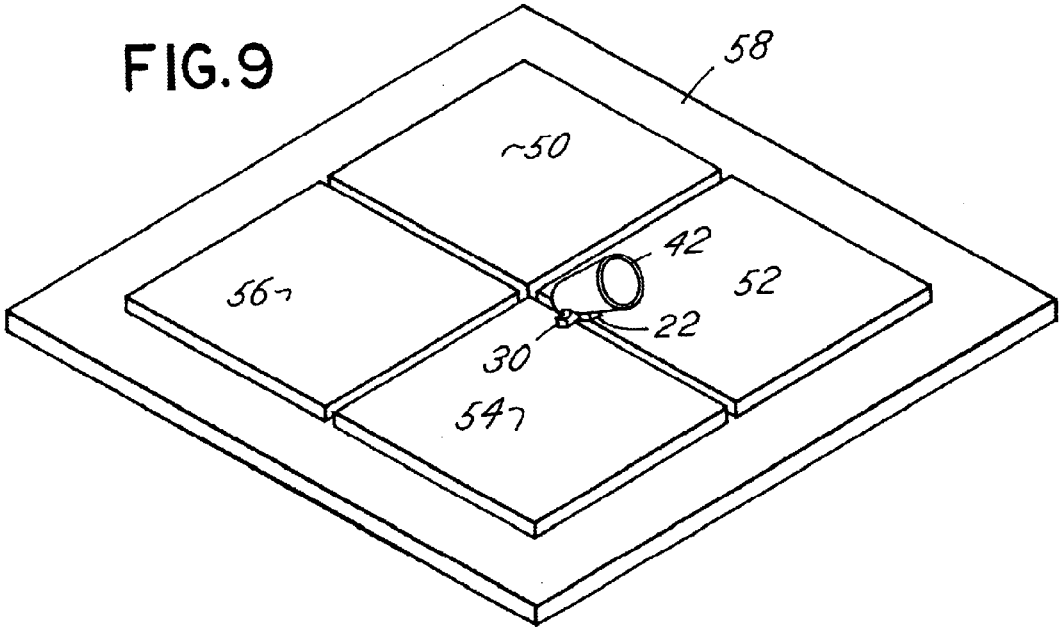
FIG. 9 is a further isometric view illustrating the manner of use of the tool of the invention and the method of the invention.

FIGS. 4, 5 and 6 provide visually various view of the tool. Of course, FIG. 7 provides yet another isometric view of the tool. FIGS. 8 and 9 illustrate the manner of use of the tool. Specifically, with respect to use, a series of tiles 50, 52, 54 and 56 are placed upon a work surface 58. An adhesive material is typically provided on the surface 58 before the tiles 50, 52, 54 and 56 are placed thereon. Initially, the tiles are arranged generally in the desired pattern or manner and substantially as desired in terms of spacing. However, the spacing is not exact and, therefore, the tool of the invention is utilized by positioning the prongs, such as prongs 22, 26, 28 and 30 between the tiles 52, 54, 56 and 50. If the tiles are square as depicted in the example of FIG. 8, then the prongs may be positioned between the junction of the four tiles. The forward prong 26, however, may be utilized to provide spacing between two adjacent tiles. In other words, the tool may be manipulated as desired by the craftsman to facilitate the appropriate spacing of the tiles by controlling the width between adjacent tiles vertically or horizontally arranged with respect to each other and at the junctions thereof.

Once the tiles are properly spaced in accord with the use of the tool and the tiles are at least partially "set", the tool may be easily removed by maintaining a workman's finger in the thimble section 42 and removing the tool. FIG. 9 is another view of the arrangement and use of the tool as depicted in FIG. 8. After the tiles are set, the tool may be used in combination with grout that is filled in between the tiles as a strike tool to shape and form the grout and in some circumstances where desired for aesthetic reasons to rake some of the grout between tiles. Also the prongs may be used to clean the space between tiles before grout is inserted. Thus, the tool has a multiplicity of uses.

FIG. 10 illustrates an alternative embodiment of the tool. In FIG. 10 prongs 70, 72, 74 and 76 extend radially outwardly from the body section 78. The body section further includes on its top side an integrally formed ring 80 which serves as a thimble section for control of the tool. Note that the thickness of the prongs 70, 72, 74 and 76 may be varied to accommodate various sizes and spacing of tile.

FIG. 11 and FIG. 12 depict a further embodiment of the invention wherein the body section 90 includes an axial slot 92 through which a band or coil 94 as shown in FIG. 12 may be fitted to provide for a thimble section which is adjustable in size. The thimble section 94 again comprises a band through which a workman may insert his finger so as to control the positioning of the cruciform array of prongs.

Additionally, the arrangement of prongs may be other than cruciform. For example, the tiles may have a unique shape, such as triangular or hexagonal and thereby require a tool which is especially designed to accommodate the number of sides associated with such tiles. In other words, the prongs may be arrayed around a body section to accommodate different arrangements of junctions between multiple tiles including junctions involving three tiles, as well as junctions involving upwards of six or more tiles. Thus, the arrangement and radial direction of the prongs may be varied as may be the number of prongs in the tool, depending upon the particular tile setting operation. Additionally, the shape of the prongs may be somewhat varied as well as the width of the prongs in the event the spacing is to be varied between adjacent tiles in a particular pattern or array. A prong 26, for example, may be elongated relative to other prongs 8. The prongs may have curved surfaces to facilitate their utilization as a rake or strike. Additionally, only one or two prongs need to be utilized to control lateral or side to side spacing of tiles. Further, the holding section may comprise a thimble (as disclosed) or a rod or a hook or other alternative structures. Thus, there are numerous variations of the tool which may be adapted and utilized without departing from the spirit and scope of the invention. The invention is, therefore, to be limited only by the following claims and equivalents thereof.

What is claimed is:

1. A tool for spacing tiles during installation comprising, in combination:

a central body having a top side, a first lateral side, a second lateral side and a bottom side;

at least two spaced coplanar prongs arranged projecting from the central body projecting radially from the central body, each of said prongs having a width portion with a width equivalent to the adjacent tile spacing; and a holding section comprising a finger tube having a closed arcuate end and an open end opposite the arcuate end for insertion of the finger, said tube mounted on the central body top side for manual positioning of the tool.

2. The tool of claim 1 wherein four prongs, each of said prongs having substantially equal width portions.

3. The tool of claim 1 wherein each prong has been an equal length of extension from the central body.

4. The tool of claim 1 wherein two prongs define a prong linear axis and the holding section includes a tube axis in the direction of engagement of the holding section by a finger, said prong axis and said tube axis being coplanar.

5. The tool of claim 1 wherein the body section and the prongs are coplanar and have an equal dimension between the top side and bottom side.

6. The tool of claim 1 including four prongs defining a cruciform in combination with the body section.

7. The tool of claim 1 wherein the holding section is a thimble.

8. A method for setting tiles in a uniformly spaced pattern comprising, in combination, the steps of:

(a) providing a tile spacing tool having a central body section with at least two coplanar prongs, each prong having width dimension and each prong projecting laterally from the central body section in a symmetrical pattern coincident with the boundaries between adjacent tiles and a finger tube member on a top side of the body section for manually holding the body section and prongs, said finger tube including a closed arcuate end and an open end opposite the arcuate end for insertion of the finger;

(b) placing tiles in adjacent relation with each other on a surface with the prongs and body section therebetween to control the spacing of the tiles by holding the body section and prongs in position by the finger tube member;

(c) moving the tiles to the controlled spacing relationship with the tool in position between adjacent tile; and (d) removing the tool by grasping the finger tube member upon arrangement of the tiles in proper spaced relation.

* * * * *